United States Patent [19]

Kuehling

[11] 4,236,302

[45] Dec. 2, 1980

[54] ELECTRICAL CONTACT FEEDING AND ATTACHMENT APPARATUS

[75] Inventor: Guenter Kuehling, Berwyn, Ill.

[73] Assignee: Bunker Ramo Corporation, Oak Brook, Ill.

[21] Appl. No.: 936,956

[22] Filed: Aug. 25, 1978

[51] Int. Cl.[3] ..... H01R 43/04

[52] U.S. Cl. ..... 29/753; 198/391; 221/160

[58] Field of Search ..... 29/753, 754, 759, 760, 29/628; 198/391; 221/159, 160

[56] References Cited

U.S. PATENT DOCUMENTS

| | | | |
|---|---|---|---|
| 2,545,756 | 3/1951 | Andren | 29/753 |
| 3,056,446 | 10/1962 | Schmidt et al. | 29/753 |
| 3,165,139 | 1/1965 | Whitney, Jr. | 29/753 |
| 3,460,230 | 8/1969 | Moulin | 29/753 |
| 3,523,316 | 8/1970 | Alexander | 10/155 |
| 3,733,883 | 5/1973 | Kaczmarek | 72/402 |
| 3,963,456 | 6/1976 | Tsuchiya et al. | 29/739 |

FOREIGN PATENT DOCUMENTS

| | | |
|---|---|---|
| 2632828 | 2/1977 | Fed. Rep. of Germany . |
| 2063643 | 7/1971 | France . |
| 1050473 | 12/1966 | United Kingdom . |

*Primary Examiner*—Carl E. Hall
*Attorney, Agent, or Firm*—F. M. Arbuckle; J. R. Hoffman

[57] ABSTRACT

A crimping apparatus or machine is disclosed in which electrical contacts of any one of a variety of conformations are fed from a receptacle or reservoir which holds a supply of contacts of selected conformation. The contacts are fed seriatim from the receptacle and are oriented and advanced to a crimping mechanism where each contact is selectively crimped to the end of an electrical cable. The receptacle includes a vibratory container which can be supplied with a plurality of contacts in a random array and the container is vibrated whereas the contacts are fed outwardly from the container along a helical path leading from the bottom of the container to an orienting mechanism. The orienting mechanism includes a downwardly inclined ramp connected to the container to be oscillated therewith so that the contacts move down the ramp one at a time due to vibration and gravity toward an advancing mechanism. The advancing mechanism is selectively actuatable and feeds the contacts seriatim to a crimping mechanism. The orienting and advancing mechanisms comprise a unitary modular unit which is bodily removable from the machine for interchangement to accommodate the variety of contact conformations. The contacts which are advanced seriatim by the advancing mechanism pass by gravity therefrom into a generally vertically oriented funnel at the crimping mechanism. The crimping mechanism is selectively changeable, including the funnel, a crimping head and a faceplate through which different sized electrical cables are inserted, for further accommodating the variety of contact conformations.

31 Claims, 6 Drawing Figures

FIG. 5
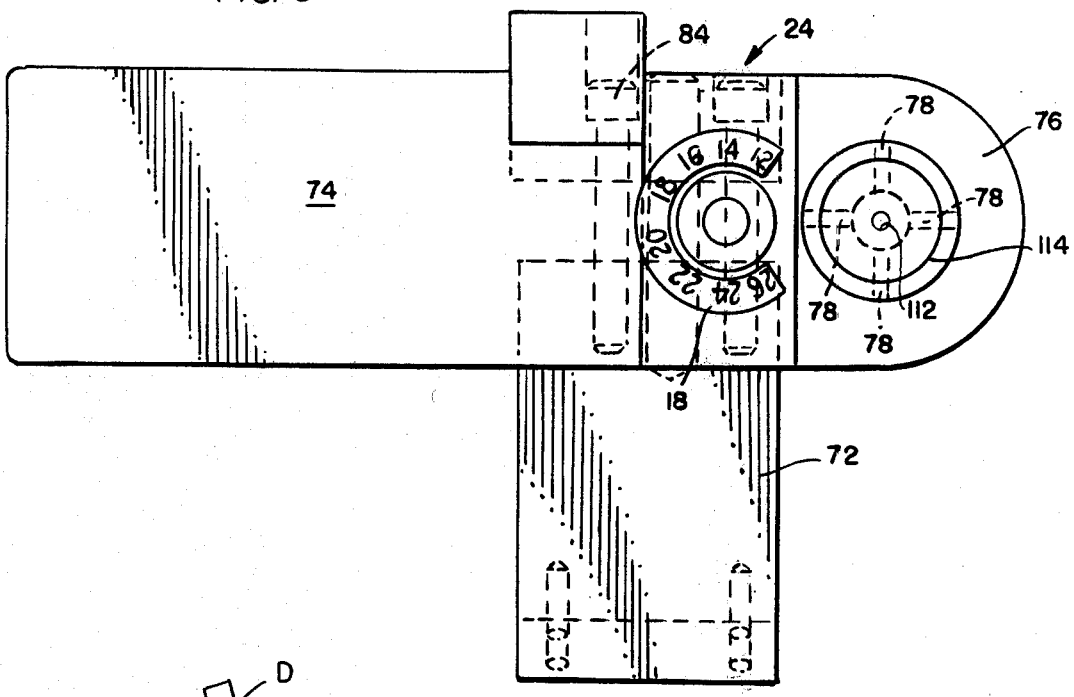
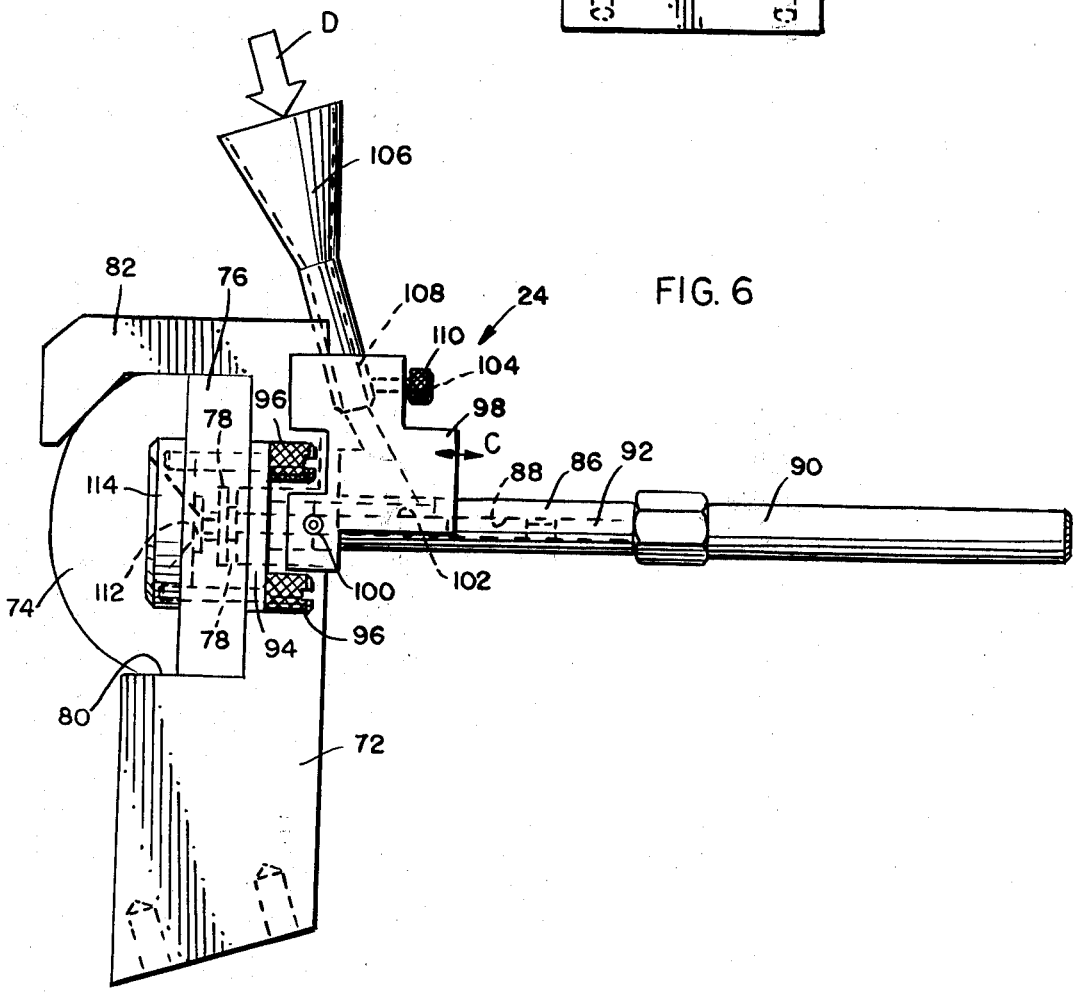
FIG. 6

ELECTRICAL CONTACT FEEDING AND ATTACHMENT APPARATUS

BACKGROUND OF THE INVENTION

This invention relates to an apparatus or machine for attaching an electrical contact to the end of an electrical conductor or cable, and more particularly to a semi-automatic device for crimping electrical contacts to electrical conductors.

Complex electrical equipment requires many thousands of electrical conductors to be interconnected to various electrical components. In most instances, these conductors are connected to connectors or contacts and the necessity has arisen for fast operating, reliable equipment or machines for attaching the contacts to the conductors. This attachment requirement becomes critical when the conductors and contacts are small in size due to the difficulties in handling the conductors and contacts. Crimping has become a widely used method of attaching the contacts to the terminal ends of the conductors or cables. Large numbers of such crimp connections are currently being made for instrumentation and control circuitry where contacts have a wide variety of conformations and where accurately dimensioned and relatively small contacts are required securely attached to their respective electrical conductors. The contacts most often vary in size and shape and, usually being small, are relatively difficult to handle. Thus, it has become desirable to provide a feeding and crimping apparatus or machine of the character described which is selectively changeable for accommodating a variety of contact conformations and which facilitates the handling of such contacts, orienting the contacts and advancing the contacts to an attachment or crimping mechanism. The machine must be such as to combine high production speed, consistent reliability, and flexibility for crimp terminated contacts.

SUMMARY OF THE INVENTION

The principal object of this invention, therefore, is to provide a new and improved apparatus or machine for handling electrical contacts and feeding the contacts to an attachment mechanism for securing the contacts to an electrical conductor.

Another object of the invention is to provide a machine of the character described which feeds the contacts seriatim from a random array thereof and advancing the contacts one at a time to a crimping means.

Important features of the invention provide for selectively changing the machine for accommodating a variety of different contact conformations.

The apparatus of the present invention is shown embodied in a crimping machine for selectively feeding electrical contacts of any one of a variety of contact conformations seriatim from a supply of the contacts and crimping each fed contact to the terminal end of an electrical cable or conductor. The machine includes receptacle means for holding the supply of contacts of selected conformation in an array of loose contacts. A crimping means, including a crimping station, is provided for crimping at least a portion of a contact onto the electrical conductor when the contact is at the crimping station. A feeding means selectively feeds a random oriented contact from the receptacle means along a path to the crimping means. A modular orienting and advancing means is located along the path between the receptacle means and the crimping means for receiving the randomly fed contacts, orienting the contacts and advancing the contacts one at a time toward the crimping means. Means are provided for selectively changing the modular orienting and advancing means for accommodating the variety of contact configurations.

The receptacle means includes a vibratory container and the orienting and advancing means includes at least a portion thereof connected to the vibratory container so as to be vibrated thereby. The vibratory container is in the form of a bowl for receiving the contacts in a random array and has a helical ramp or track for moving the contacts from the bottom of the bowl to the orienting and advancing means. The orienting and advancing means includes a downwardly inclined orienting ramp leading from the vibratory container whereby the contacts move down the ramp by vibration and gravity. A selectively actuatable reciprocating plunger has a vertical aperture portion through which a single contact can pass by gravity from the lower end of the orienting ramp toward the crimping means. The orienting and advancing means comprises a modular unit which is mounted on the machine by means so as to be bodily removable therefrom for interchangement to accommodate the variety of contact configurations.

The crimping means is selectively changeable for accommodating the variety of contact conformations. More particularly, the crimping means includes a funnel for gravitationally receiving contacts fed from the orienting and advancing means, a crimping head and a faceplate through which the conductors or cables are inserted for attachment to the contacts. The funnel, crimping head and faceplate are removable for changing the crimping means to accommodate the variety of contact conformations.

Other objects, features and advantages of the invention will be apparent from the following detailed description taken in connection with the accompanying drawings.

DESCRIPTION OF THE DRAWINGS

FIG. 5 is a front elevational view of part of the crimping means of the present invention; and FIG. 6 is a side elevational view of the crimping mechanism.

DETAILED DESCRIPTION OF THE INVENTION

Figure 1:
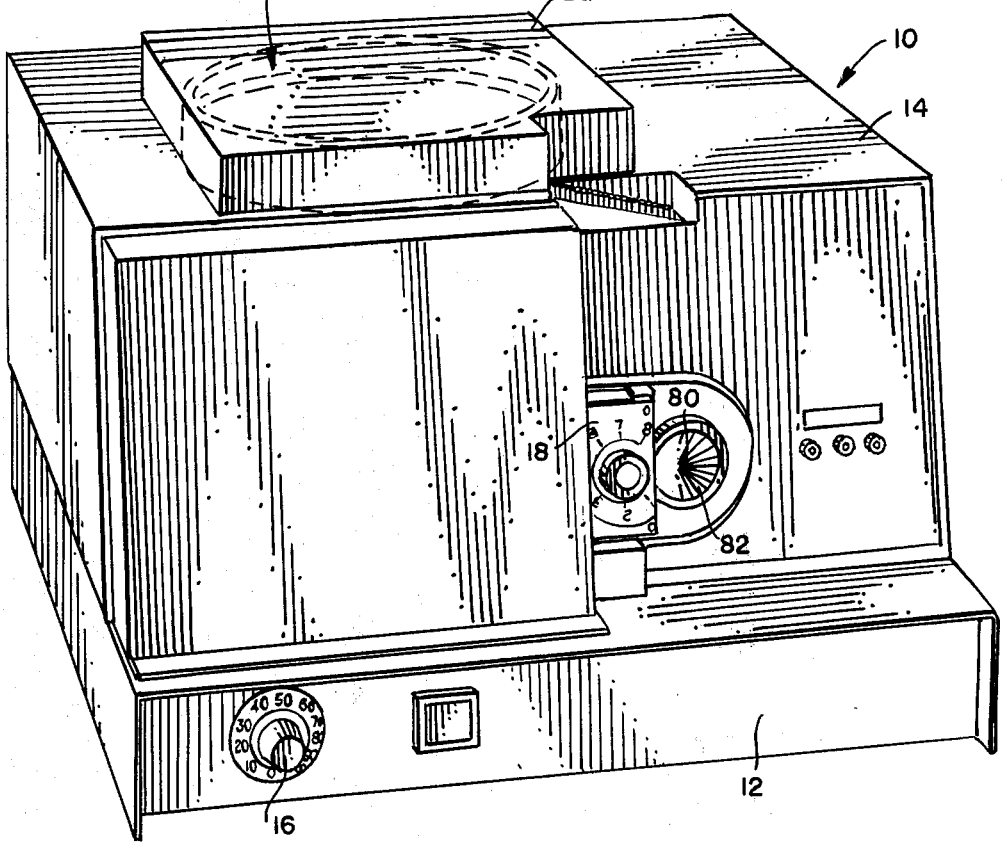
FIG. 1 is a front perspective view of the apparatus of the present invention.

Referring to the drawings in greater detail, a crimping apparatus or machine embodying the concepts of the present invention is shown and generally designated 10 (FIG. 1) and includes a main frame having a base portion 12. The machine includes a top cover 14 within which is housed most of the operative components of the machine. Dials 16 and 18 are shown on the front of the machine, and the top cover 14 has a portion 20 which may be integral therewith or separable therefrom and beneath which the receptacle means of the invention as described hereinafter is located. The crimping machine of the present invention is provided for selectively feeding electrical contacts of any one of a variety of contact configurations seriatim from a supply of the contacts and crimping each fed contact to the terminal end of an electrical conductor or cable (not shown). More particularly, the crimping machine includes receptacle means, generally designated 22 (FIGS. 1 through 3), for holding the supply of contacts of selected configuration in an array of loose contacts. Crimping means, generally designated 24 (FIGS. 5 and 6), including a crimping station, is provided for crimping at least a portion of a contact fed through the machine onto the electrical conductor when the contact is at the crimping station of the crimping means. Feeding means, including portions of the receptacle means 22 and crimping means 24, is provided for selectively feeding a random oriented contact from the receptacle means 22 along a path through the machine from the receptacle means to the crimping means 24. A modular orienting and advancing means, generally designated 26 (FIGS. 2 through 4), is located along the path of the feeding means from the receptacle means 22 to the crimping means 24 for receiving the randomly fed contacts from the receptacle means 22, orienting the contacts and advancing the contacts one at a time toward the crimping means 24.

Figure 2:
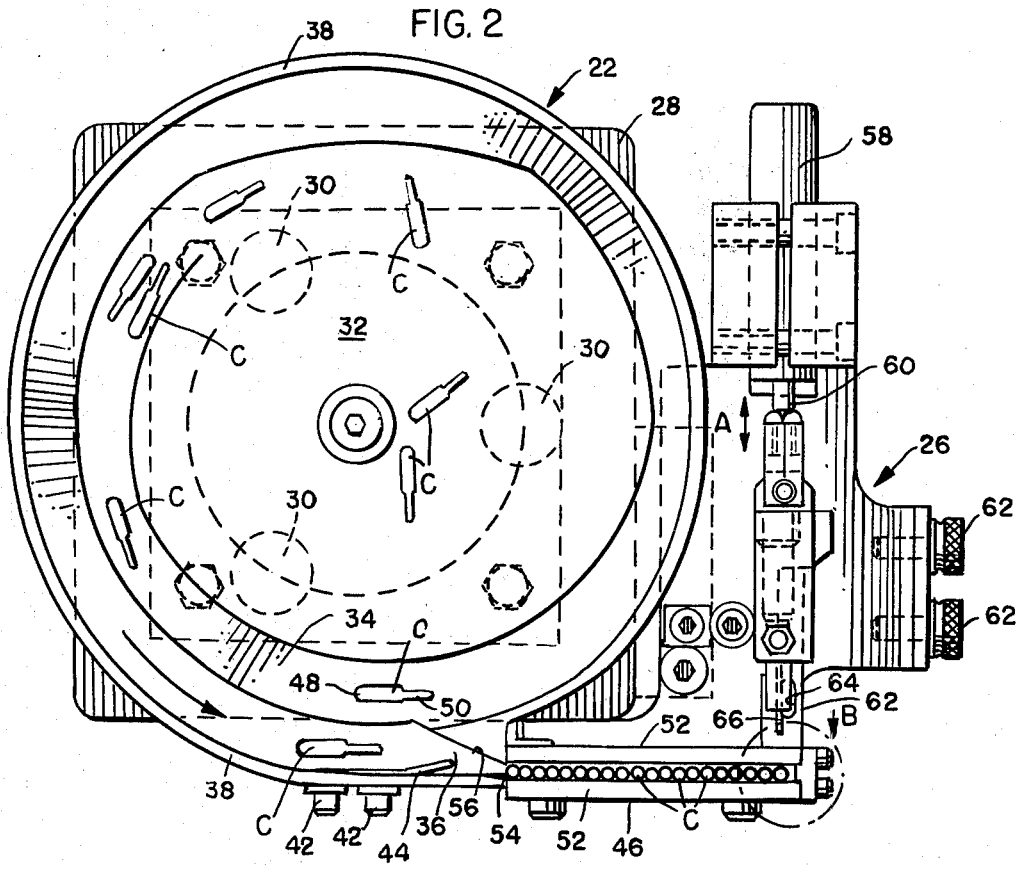
FIG. 2 is a top plan view, on an enlarged scale, of the receptacle means and the orienting and advancing means of the present invention.
Figure 3:
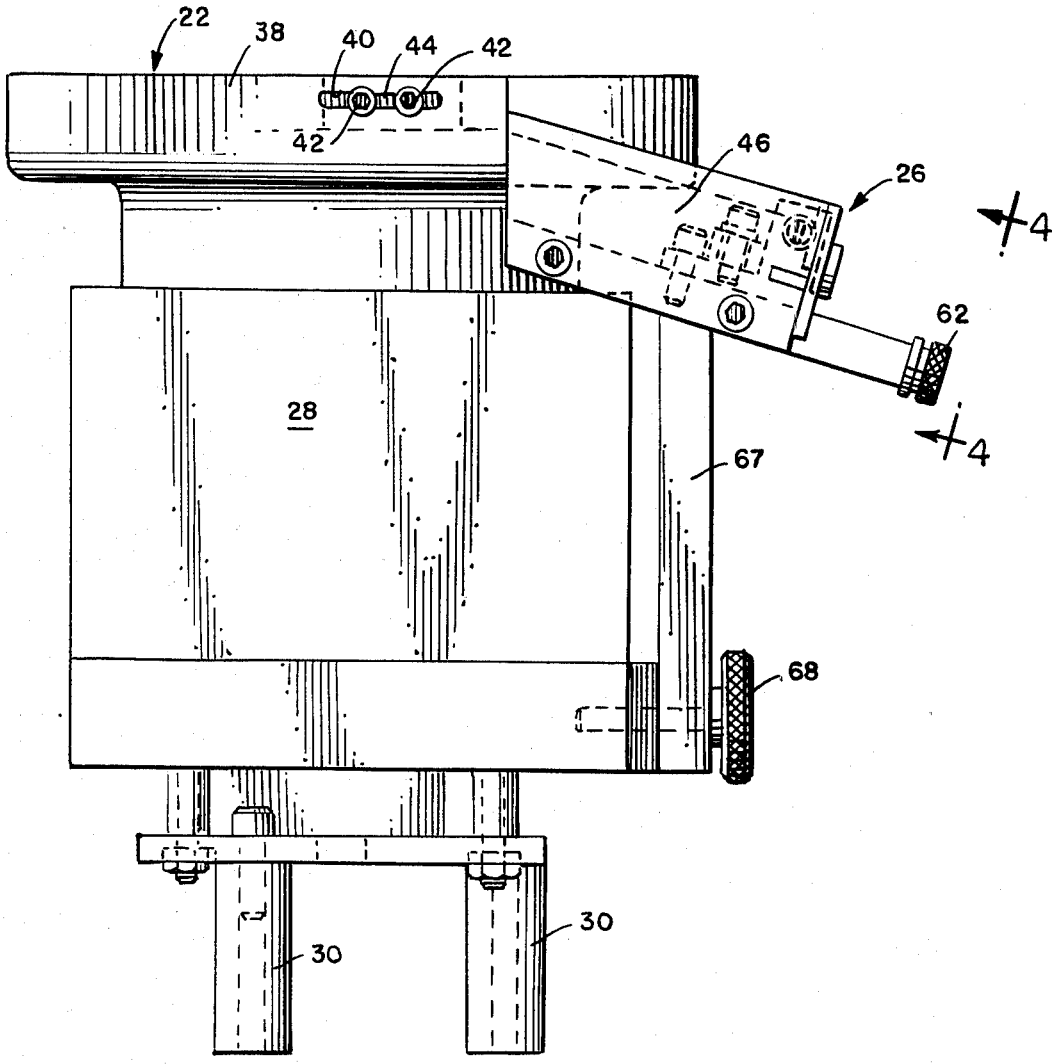
FIG. 3 is a front elevational view taken generally in the direction of line 3—3 of FIG. 2.

The receptacle means 22 includes a main base 28 (FIGS. 2 and 3) which is mounted on top of vibratory risers 30 so that the container is vibrated or oscillated as is known in the art. The container generally is in the form of a bowl which has a bottom wall 32 (FIG. 2) and in which a supply of contacts C are loaded into the container, the contacts being of any one of a variety of contact conformations, sizes or shapes. The container has a helical ramp 34 which leads upwardly from the bottom wall 32 of the container along which the contacts ride due to vibration of the container until the contacts reach a discharge end 36 of the ramp. The container has a side wall 38 which has a slot 40 (FIG. 3) through which a pair of adjusting thumb screws 42 protrude at the front of the container as shown in FIGS. 2 and 3. The thumb screws 42 are connected to a baffle plate 44 on the inside of the container wall 38 at the discharge end 36 of the helical ramp 34. The baffle plate 44 thereby can be adjusted horizontally or laterally to adjust the path of movement of the contacts C as the contacts engage the baffle plate at the discharge ending 36 of the helical ramp 34.

The modular orienting and advancing means 26 (FIGS. 2 through 4) includes an orienting portion in the form of a chute-type ramp 46 which is inclined downwardly from the discharge end 36 at the top of the helical ramp 34 of the receptacle means 22. As shown in FIG. 2, the contacts C are shaped so as to have a hollow enlarged ferrule portion 48 and a solid terminal portion 50. The ferrule portion 48, being hollow, is lighter than the solid portion 50 of the contact. The ramp 46 of the orienting and advancing means 26 has parallel upwardly protruding side walls 52 (FIG. 2) spaced at least the width of the contact ferrule portion 48 and a bottom slot 54 narrower than the width of the contact ferrule portion 48 but sufficiently wide for the solid terminal contact portion 50 to extend downwardly therethrough. Since the contact terminal portion 50 is heavier than the ferrule portion 48, as the contacts pass one at a time from the discharge end 36 of the container ramp 34 in a generally horizontal disposition, the heavier terminal portion 50 will drop into the slot 54 of the orienting ramp 46 so that the contacts attain a vertical disposition in a side-by-side array as shown in FIG. 2 with the ferrule portion 48 extending upwardly. The discharge end 36 of the container 34 is tapered, as at 56, to facilitate the contacts entering the upper end of the orienting ramp 46 one at a time because excess contacts will fall off the tapered portion 56 of the ramp. The adjustable baffle plate 44 also facilitates this seriatim feeding of the contacts.

Figure 4:
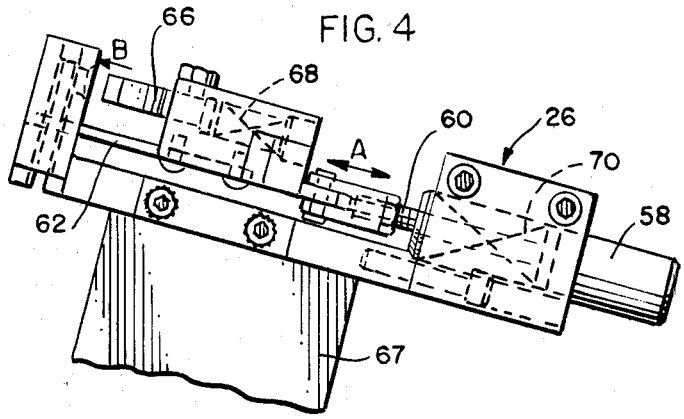
FIG. 4 is a fragmented elevational view taken generally in the direction of line 4—4 of FIG. 3.

The modular orienting and advancing means 26 also includes an advancing mechanism for advancing the contacts one at a time from the lower end of the orienting chute or ramp 46 toward the crimping means 24. More particularly, the advancing mechanism is best seen in FIGS. 2 through 4 and includes a piston and cylinder device 58 which is connected by appropriate means and is selectively actuatable by the operator of the machine. The piston of the pneumatic piston and cylinder device 58 has a portion 60 in the form of a plunger which protrudes therefrom for reciprocation back and forth in the direction of double headed arrow A (FIGS. 2 and 4). Thumb screws 62 are provided for facilitating attachment to the pneumatic system, and known quick disconnect couplings can be used to further facilitate quick and ready changing of the orienting and advancing means 26 for accommodating the variety of contact configurations, as described hereinafter. The plunger 60 has a generally horizontal plate 62 secured to the end thereof for reciprocation therewith. The plate 62 has an oblong aperture 64 (FIG. 2) through which a single contact can drop from the lower end (the right-hand end as viewed in FIGS. 2 and 3) of the orienting chute 46. When the plunger 60 and plate 62 are in a retracted position as shown in FIG. 2, the lowermost contact in the orienting chute 46 rests on top of the plate 62. A generally vertically oriented stop plate 66 also is mounted for reciprocation with the plunger 60 and horizontal plate 62 adjacent the inside of the aperture 64 so that as the plunger 60, apertured plate 62 and stop plate 66 move forwardly in the direction of arrow B (FIGS. 2 and 4), the stop plate 66 precludes the next or second contact at the bottom of the orienting ramp 46 from falling through the aperture 64.

Thus, as the pneumatic system is selectively actuated by an operator of the machine, through the piston and cylinder device 58, the plunger 60, apertured plate 62 and stop plate 66 are driven forwardly in the direction of arrow B to advance contacts C from the orienting chute 46 seriatim to the crimping means 26 described hereinafter. Springs 68 and 70 (FIG. 4) return the plunger 60, apertured plate 62 and stop plate 64 rearwardly opposite the direction of arrow B after actuation of the pneumatic piston and cylinder device 58.

The entire orienting and advancing means 26 is a singular modular unit and is mounted on top of a vertical support plate 67 (FIGS. 3 and 4) which, in turn, is removably mounted to the base 28 of the receptacle means by thumb screws 68 (FIG. 3). This provides for easy and quick interchangeability of orienting and advancing units for accommodating a variety of contact configurations of various sizes and shapes. In addition, the unit being connected directly to the vibratory receptacle means, the orienting chute is vibrated thereby so that the contacts move down the chute by vibration and gravity.

The crimping means 24 of the present invention is shown best in FIGS. 5 and 6 and includes modular components thereof which are removably mounted on a frame portion 72 of the machine for interchangeability purposes for accommodating a variety of contact configurations. More particularly, the crimping means 24 includes an enlarged cylindrical piston and cylinder device 74 which has a crimping head 76 disposed at one end thereof (the right-hand end as viewed in FIG. 5). The piston and cylinder device is effective to operate in conventional manner a plurality of crimping fingers 78 disposed within the crimping head 76 for crimping or clamping the ferrule portion 48 of an individual contact C onto the terminal end of a conductor or cable. This composite construction is removably mounted on the frame portion 72 of the machine by positioning the housing of the cylindrical piston and cylinder device 74 between a lower shoulder 80 (FIG. 6) and an upper jaw 82 of the frame member 72 and clamping thereto by a bolt 84 (FIG. 5) threaded at its lower end into the frame member 72. The piston and cylinder device 74 is appropriately connected to the pneumatic system of the machine for actuation thereof and may be spring loaded for automatic return of the piston on its back stroke after selective actuation of the piston and cylinder device to operate the crimping fingers 78 on the forward stroke of the piston.

The crimping means 24 further includes a tubular element 86 (FIG. 6) which has an interior bore 88 directed toward the backside of the crimping head 76. The tubular element 86 forms an extension of a double acting piston and cylinder device 90 which has a plunger portion 92, forming an extension of the piston thereof, which moves within bore 88. The tubular element 86 has a flange portion 94 at the forward end thereof and is removably connected to the crimping head 76 by means of thumb screws 96. A block element 98 is positioned over the tubular element 86 for sliding movement back and forth therealong in the direction of double headed arrow C (FIG. 6) for adjustment purposes. A set screw 100 having a knurled periphery is threaded through the block element 98 and abuts at its inner end with the side of the tubular element 86 to selectively fix the position of the block element 98 relative to the tubular element 86. The tubular element 86 has an upwardly opening axially extending notch or groove 102 in communication with the interior bore 88 and at least the length of a contact C. The block element 98 has a slightly canted upwardly extending interior bore 104, enlarged at its lower end, in communication with the open notch 102 of the tubular element 86. A funnel member 106 is positioned within an enlarged portion 108 of the bore 104 in communication therewith and is selectively removable or interchangeable by means of a knurled thumb screw 110.

Thus, as the orienting and advancing means 26 feeds a contact C seriatim therefrom, the contact will drop by gravity generally vertically into the top of funnel 106 generally in the direction of arrow D (FIG. 6) into the chute 106 with the ferrule portion of the contact pointing upwardly. The contact falls through the bore 104 of the block element 98 and through the upwardly opening notch 102 of the tubular element 86 and comes to rest within the horizontal bore 88 of the tubular element 86, with the ferrule portion of the contact facing the crimping head 76 (to the left in FIG. 6). During a cycle of operation of the machine, the double acting piston and cylinder device 90 is actuated to drive the rod or plunger 92 to the left as viewed in FIG. 6 to feed a contact C (ferrule end first) into the crimping head 76 for receiving the conductor portion of a cable within the contact ferrule for crimping purposes. The piston and cylinder device 74 then is selectively actuated or cyclically actuated to close the crimping fingers 78 to crimp the contact ferrule over the conductor end of the cable.

The conductor or cable is inserted through an aperture 112 in the center of a face plate 114 which abuts against the front face of the crimping head 76 and which is maintained in place by the threaded ends of the thumb screws 96 which are threaded into the back side of the face plate 114. In other words, the thumb screws 96 extend through the flange 94 at the front end of the tubular element 86, through the crimping head 76, and into the face plate 114, as best seen in FIG. 6. In this manner, the entire feeding portion of the crimping means 24 (which includes the tubular contact feeding element 86, the block element 98 and the funnel 106) and the face plate 114 are removable from the crimping head 76 by loosening the thumb screws 96, for interchangeability purposes for accommodating a variety of contact conformations. The crimping head 76 along with the piston and cylinder device 74 themselves are removable with or without the aforesaid feeding elements of the crimping means 24 and the face plate 114 by loosening the bolts 84, again for interchangeability purposes for accommodating a variety of contact configurations. The funnel 106 can be separately interchanged by loosening the thumb screw 110, and the face plate 114 can be individually interchanged by loosening the thumb screws 96.

While a particular embodiment of the present invention has been shown and described, it is apparent that various changes and modifications may be made, and it is therefore intended in the following claims to cover all such modifications and changes as may fall within the true spirit and scope of this invention.

I claim:

1. A crimping machine for selectively feeding electrical contacts of any one of a variety of contact conformations seriatim from a supply of said contacts and crimping each fed contact to the terminal end of an electrical conductor, comprising:

a base;

receptacle means on said base for holding the supply of contacts of selected conformation in an array of loose contacts;

crimping means, including a crimping station, for crimping at least a portion of a contact onto the electrical conductor when the contact is at the crimping station;

feeding means for selectively feeding a random oriented contact from said receptacle means along a path to the crimping means;

interchangeable modular orienting and advancing means, including a common support structure, located along said path between the receptacle means and the crimping means for receiving the randomly fed contacts, orienting the contacts and advancing the contacts one at a time toward the crimping means; and means mounting the common support structure of said modular orienting and advancing means on said base for ready removal therefrom whereby the entire modular orienting and advancing means is bodily removable and interchangeable for accommodating the variety of contact conformations.

2. The crimping machine of claim 1 wherein said orienting and advancing means includes an orienting portion and an advancing portion, said advancing portion being selectively actuatable for advancing the contacts seriatim along said path toward the crimping means.

3. The crimping machine of claim 1 wherein said crimping means is selectively actuatable for crimping the contacts fed seriatim from said orienting and advancing means.

4. The crimping machine of claim 1 wherein said mounting means comprises at least one thumb screw, whereby the entire orienting and advancing means is bodily removable from said base for interchangement to accommodate the variety of contact conformations.

5. The crimping machine of claim 1 wherein said receptacle means includes a vibratory container and said orienting and advancing means includes at least a portion thereof connected to said vibratory container so as to be vibrated thereby.

6. The crimping machine of claim 5 wherein said portion of the orienting and advancing means comprises a downwardly inclined orienting ramp leading from said vibratory container whereby the contacts move down the ramp by vibration and gravity.

7. The crimping machine of claim 1 wherein said crimping means includes means selectively changeable for accommodating the variety of contact conformations.

8. The crimping machine of claim 7 wherein said crimping means includes a funnel for gravitationally receiving contacts fed along said path, and means for removably mounting the funnel for interchangement to accommodate the variety of contact conformations.

9. The crimping machine of claim 7 wherein said crimping means includes a crimping head, and means for removably mounting the crimping head for interchangement to accommodate the variety of contact conformations.

10. The crimping machine of claim 7 wherein said crimping means includes a faceplate for insertion of the electrical cable therethrough into the machine, and means for removably mounting the faceplate for interchangement to accommodate different sized cables for attachment to the variety of contact conformations.

11. The crimping machine of claim 1 wherein said orienting and advancing means includes a selectively actuatable reciprocating plunger which includes a vertical aperture portion through which a single contact can pass by gravity from said ramp along said path toward said crimping means.

12. The crimping machine of claim 11 wherein said plunger also includes a stop plate movable therewith adjacent the lower end of said ramp to preclude more than a single contact from passing through the aperture.

13. A crimping machine for selectively feeding electrical contacts of any one of a variety of contact conformations seriatim from a supply of said contacts and crimping each fed contact to the terminal end of an electrical conductor, comprising:

a base;

receptacle means on said base for holding the supply of contacts of selected conformation in an array of loose contacts;

crimping means, including a crimping station, for crimping at least a portion of a contact onto the electrical conductor when the contact is at the crimping station;

feeding means for selectively feeding a random oriented contact from said receptacle means along a path to the crimping means;

an interchangeable modular orienting mechanism, including a support structure, located along said path between the receptacle means and the crimping means for receiving the randomly fed contacts and orienting the contacts one at a time for feeding toward the crimping means; and means for mounting the support structure of said modular orienting mechanism on said base so as to be bodily removable therefrom for ready interchangement of the entire modular orienting mechanism to accommodate the variety of contact conformations.

14. The crimping machine of claim 13 wherein said receptacle means includes a vibratory container and said orienting mechanism is connected to said vibratory container so as to be vibrated thereby.

15. The crimping machine of claim 14 wherein said orienting mechanism includes a downwardly inclined orienting ramp leading from said vibratory container whereby the contacts move down the ramp by vibration and gravity.

16. A crimping machine for selectively feeding electrical contacts of any one of a variety of contact conformations seriatim from a supply of said contacts and crimping each fed contact to the terminal end of an electrical conductor, comprising:

a base;

receptacle means on said base for holding the supply of contacts of selected conformation in an array of loose contacts;

crimping means, including a crimping station, for crimping at least a portion of a contact onto the electrical conductor when the contact is at the crimping station;

feeding means for selectively feeding a random oriented contact from said receptacle means along a path to the crimping means;

interchangeable modular advancing means, including a support structure located along said path between the receptacle means and the crimping means for receiving fed contacts and advancing the contacts one at a time toward the crimping means; and means for mounting the support structure of said modular advancing mechanism on said base so as to be bodily removable therefrom for ready interchangement of the entire modular advancing means to accommodate the variety of contact conformations.

17. The crimping machine of claim 16 wherein said advancing mechanism includes a selectively actuatable reciprocating plunger which includes a vertical aperture portion through which a single contact can pass by gravity along said path toward said crimping means.

18. The crimping machine of claim 17 including an orienting mechanism along said path for feeding the randomly fed contacts and orienting the contacts, and said plunger includes a stop plate movable therewith adjacent the orienting mechanism to preclude more than a single contact from passing through the aperture.

19. A crimping machine for selectively feeding electrical contacts of any one of a variety of contact conformations seriatim from a supply of said contacts and crimping each fed contact to the terminal end of an electrical conductor, comprising:

a base;

receptacle means on said base for holding the supply of contacts of selected conformation in an array of loose contacts;

crimping means, including a crimping station, for crimping at least a portion of a contact onto the electrical conductor when the contact is at the crimping station;

feeding means for selectively feeding a random oriented contact from said receptacle means along a path to the crimping means;

interchangeable modular orienting and advancing means, including a common support structure, located along said path between the receptacle means and the crimping means for receiving the randomly fed contacts, orienting the contacts and advancing the contacts one at a time toward the crimping means;

means mounting the common support structure of said modular orienting and advancing means on said base so as to be bodily removable therefrom for ready interchangement of the entire modular orienting and advancing means to accommodate the variety of contact conformations; and said crimping means including means selectively changeable for accommodating the variety of contact conformations.

20. The crimping machine of claim 19 wherein said crimping means includes a funnel for gravitationally receiving contacts fed along said path, and means for removably mounting the funnel for interchangement to accommodate the variety of contact conformations.

21. The crimping machine of claim 19 wherein said crimping means includes a crimping head, and means for removably mounting the crimping head for interchangement to accommodate the variety of contact conformations.

22. The crimping machine of claim 19 wherein said crimping means includes a faceplate for insertion of the electrical cable, and means for removably mounting the faceplate for interchangement to accommodate different sized cables for attachment to the variety of contact conformations.

23. The crimping machine of claim 19 wherein said crimping means includes a crimping head and a feeding portion for feeding contacts individually to said crimping head, and means for removably mounting said feeding portion for interchangement to accommodate the variety of contact conformations.

24. The crimping machine of claim 23 wherein said last named means removably mounts said feeding portion directly on said feeding head.

25. A crimping machine for selectively feeding electrical contacts of any one of a variety of contact conformations seriatim from a supply of said contacts and crimping each fed contact to the terminal end of an electrical conductor, comprising:

receptacle means for holding the supply of contacts of selected conformation in an array of loose contacts;

crimping means, including a crimping station, for crimping at least a portion of a contact onto the electrical conductor when the contact is at the crimping station;

feeding means for selectively feeding a random oriented contact from said receptacle means along a path to the crimping means;

said crimping means including an interchangeable composite modular crimping head portion including a plurality of crimping fingers and a feeding portion;

means for removably mounting the entire composite crimping head portion of said crimping means for ready removal and interchangement to accommodate the variety of contact conformations; and means for removably mounting the feeding portion of said crimping means for interchangement to accommodate the variety of contact conformations.

26. The crimping machine of claim 25 wherein said crimping means includes a funnel for gravitationally receiving contacts fed along said path to the feeding portion of the crimping means, and means for removably mounting the funnel for interchangement to accommodate the variety of contact conformations.

27. The crimping machine of claim 26 wherein said funnel is removably mounted by said last named means to the feeding portion of said crimping means.

28. The crimping machine of claim 25 wherein said crimping means includes a face plate for insertion of the electrical cable, and means for removably mounting the face plate for interchangement to accommodate different sized cables for attachment to the variety of contact conformations.

29. The crimping machine of claim 28 wherein said face plate is removably mounted by said last named means on the crimping head portion of said crimping means.

30. The crimping machine of claim 25 wherein said feeding portion of said crimping means is removably mounted on the crimping head portion of said crimping means.

31. The crimping machine of claim 25 including a modular orienting and advancing means located along said path between the receptacle means and the crimping means for receiving the randomly fed contacts, orienting the contacts and advancing the contacts one at a time toward the crimping means, and means mounting said orienting and advancing means on the machine so as to be bodily removable therefrom for interchangement to accommodate the variety of contact conformations.

* * * * *